US007198014B2

(12) United States Patent
Kanada et al.

(10) Patent No.: US 7,198,014 B2
(45) Date of Patent: Apr. 3, 2007

(54) VALVE TIMING CONTROL APPARATUS AND METHOD FOR SETTING MINIMUM TORQUE

(75) Inventors: Yoji Kanada, Gamagori (JP); Osamu Komazawa, Chita (JP)

(73) Assignee: Aisin Seiki Kabushiki Kaisha, Aichi-ken (JP)

( * ) Notice: Subject to any disclaimer, the term of this patent is extended or adjusted under 35 U.S.C. 154(b) by 0 days.

(21) Appl. No.: 11/293,085

(22) Filed: Dec. 5, 2005

(65) Prior Publication Data

US 2006/0130790 A1 Jun. 22, 2006

(30) Foreign Application Priority Data

Dec. 16, 2004 (JP) ..... 2004-364142

(51) Int. Cl.
*F01L 1/34* (2006.01)

(52) U.S. Cl. ..... 123/90.17; 123/90.15; 123/90.31

(58) Field of Classification Search ..... 123/90.17, 123/90.15, 90.31
See application file for complete search history.

(56) References Cited

U.S. PATENT DOCUMENTS 6,062,182 A 5/2000 Ogawa
6,155,219 A 12/2000 Fukuhara et al.
6,457,447 B1 10/2002 Sato et al.
2001/0022164 A1 9/2001 Ogawa
2001/0039933 A1 11/2001 Sato et al.
2002/0100445 A1 8/2002 Takenaka et al.
2003/0121486 A1 7/2003 Komazawa et al.
2003/0233990 A1* 12/2003 Ogawa ..... 123/90.15
2005/0016481 A1 1/2005 Komazawa et al.

FOREIGN PATENT DOCUMENTS

JP 2000-179314 12/1998
JP 2000-145415 7/1999

* cited by examiner

*Primary Examiner*—Thomas Denion
*Assistant Examiner*—Zelalem Eshete
(74) *Attorney, Agent, or Firm*—Reed Smith LLP; Stanley P. Fisher, Esq.; Juan Carlos A. Marquez, Esq.

(57) ABSTRACT

In a valve timing control apparatus, a relative rotational phase between a drive rotational member rotated with a crankshaft and a driven rotational member rotated with a camshaft is controlled by a relative rotational phase-controlling mechanism utilizing a fluid pressure in a fluid pressure chamber divided by a vane. The relative rotational phase can be restrained by a locking mechanism at an intermediate phase between most advanced and most retarded angle phases. As a minimum set torque applied by a biasing mechanism to the drive rotational member relative to the driven rotational member, a larger minimum torque required for change from the most retarded angle phase to the intermediate phase during cranking, at a temperature before warming up while fluid pressure is discharged, or at a minimum temperature for relative rotational phase control while a fluid pressure remains, is selected.

19 Claims, 10 Drawing Sheets

VALVE TIMING CONTROL APPARATUS AND METHOD FOR SETTING MINIMUM TORQUE

CROSS REFERENCE TO RELATED APPLICATIONS

This application is based on and claims priority under 35 U.S.C. § 119 to Japanese Patent Application 2004-364142, filed on Dec. 16, 2004, the entire content of which is incorporated herein by reference.

FIELD OF THE INVENTION

The present invention generally relates to a valve timing control apparatus and a method for setting a minimum torque. More particularly, the present invention pertains to a valve timing control apparatus for controlling, on the basis of an operational condition of an engine mounted on a vehicle, an open/close timing of either or both of an intake valve and an exhaust valve of the engine, and a method for setting a torque generated by a biasing mechanism provided between a drive rotational member and a driven rotational member for biasing the driven rotational member toward an advanced angle.

BACKGROUND

Conventionally, a valve timing control apparatus includes a drive rotational member synchronously rotated with a crankshaft, a driven rotational member provided coaxially with the drive rotational member and rotated with a camshaft, a fluid pressure chamber provided in at least one of the drive rotational member and the driven rotational member, a vane dividing the fluid pressure chamber into an advanced angle chamber and a retarded angle chamber, and a relative rotational phase-controlling mechanism for supplying or discharging a working fluid to or from one or both of the advanced angle chamber and the retarded angle chamber for changing a relative position of the vane to the fluid pressure chamber and for controlling a relative rotational phase between the drive rotational member and the driven rotational member within a range from a most retarded angle phase at which a volume of the retarded angle chamber becomes maximum and a most advanced angle phase at which a volume of the advanced angle chamber becomes maximum.

Further, a biasing mechanism (for example, a torsion spring) is provided between the drive rotational member and the driven rotational member for biasing the relative rotational phase between the rotational members toward the maximum advanced angle phase.

Further, a locking mechanism is provided for restraining the relative rotational phase between the drive rotational member and the driven rotational member so as to start an engine at an optimum condition.

In the locking mechanism, for example, for making a state of lock, a locking member provided at the drive rotational member is biased toward the driven rotational member by means of spring, and the locking member is inserted into a locking fluid chamber provided at the driven rotational member. Thus, the relative rotation is restrained. For releasing the state of lock, a locking fluid is supplied into the locking fluid chamber to increase a fluid pressure, and the locking member is pulled back toward the drive rotational member.

In a conventional valve timing control apparatus including the control mechanism for the relative rotational phase, the biasing mechanism, and the locking mechanism, a torque of the biasing means is set on the basis of an average torque of the camshaft. In other words, according to a first conventional technique (for example, described in US2001/0039933A), a minimum of the torque of the biasing mechanism is set to 10% of an average torque within an idling rotational range of the camshaft, and a maximum of the torque of the biasing mechanism is set to an average torque of the camshaft rotating under its own inertia. Further, according to a second conventional technique (for example, described in U.S. Pat. No. 6,155,219A), the maximum is set to an average inertia torque of the camshaft within a period until the spark ignition occurs after-one cycle of rotation of the crankshaft at the start time of the combustion engine.

Recently, in order not only to obtain smooth start of an engine, but also to obtain an adjustable range of the relative rotational phase between the rotational members both in the advanced angle and in the retarded angle, a valve timing control apparatus is proposed in which a lock phase, at which a locking mechanism inhibits the relative rotation between the rotational members, is provided in an intermediate phase between the most retarded angle phase and the most advanced angle phase.

Further, a similar kind of a valve timing control apparatus having an intermediate lock structure is proposed in which the relative rotational phase is restricted from going back toward the retarded angle at a single step or plural steps, the relative rotational phase is sequentially stepped up toward the intermediate phase, and thus an intermediate lock is rapidly realized.

In view of the lock phase, in the first conventional technique and the second conventional technique, the lock phase is not set to the intermediate phase. In other words, in the apparatus described in the first conventional technique, as described in a paragraph [0028] and FIG. 2 in JP2000-179314A (US2001/0039933A), the lock phase is set to the most retarded angle phase. In contrast, in the apparatus described in the second conventional technique, as described in a paragraph [0025] and FIG. 2 in JP2000-145415A (U.S. Pat. No. 6,155,219A), the lock phase is set to the most advanced angle phase.

As described above, in a field of the valve timing control apparatus of the intermediate locking structure, a technique for setting a torque of the biasing mechanism is not sufficiently established. Accordingly, a torque has been relatively roughly set for the biasing mechanism.

In a valve timing control apparatus having a lock phase (so called an intermediate phase) at which a locking mechanism functions, a need thus exists for a valve timing control apparatus in which a torque generated by a biasing mechanism can be set without excess or deficiency, a relative rotational phase can be easily controlled, and an intermediate lock can be realized with reliability. Further, a need thus exists for a method for setting a torque of a biasing mechanism enabling to realize such apparatus. The present invention has been made in view of the above circumstances and provides such a valve timing control apparatus and a method for setting a torque of a biasing mechanism.

SUMMARY OF THE INVENTION

According to an aspect of the present invention, a valve timing control apparatus for an engine includes a drive rotational member synchronously rotated with a crankshaft, a driven rotational member provided coaxially with the drive rotational member and rotated with a camshaft, a fluid pressure chamber provided in one of the drive rotational member and the driven rotational member, a vane dividing the fluid pressure chamber into an advanced angle chamber and a retarded angle chamber, a relative rotational phase-controlling mechanism for supplying or discharging a working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum, a locking mechanism for restraining the relative rotational phase at an intermediate phase between the most advanced angle phase and the most retarded angle phase, and a biasing mechanism for applying a torque to the drive rotational member relative to the driven rotational member so that the relative rotational phase advances toward the most advanced angle phase. A larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as a minimum set torque for the biasing mechanism.

According to a further aspect of the present invention, in a method for setting a minimum torque for a biasing mechanism of a valve timing control apparatus for an engine, the valve timing control apparatus includes a drive rotational member synchronously rotated with a crankshaft, a driven rotational member provided coaxially with the drive rotational member and rotated with a camshaft, a fluid pressure chamber provided in one of the drive rotational member and the driven rotational member, a vane dividing the fluid pressure chamber into an advanced angle chamber and a retarded angle chamber, a relative rotational phase-controlling mechanism for supplying or discharging an working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum, a locking mechanism for restraining the relative rotational phase at an intermediate phase between the most advanced angle phase and the most retarded angle phase, and a biasing mechanism for applying a torque to the drive rotational member relative to the driven rotational member so that the relative rotational phase advances toward the most advanced angle phase. A larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as the minimum torque.

BRIEF DESCRIPTION OF THE DRAWINGS

The foregoing and additional features and characteristics of the present invention will become more apparent from the following detailed description considered with reference to the accompanying drawings, wherein.

DETAILED DESCRIPTION

Figure 1:
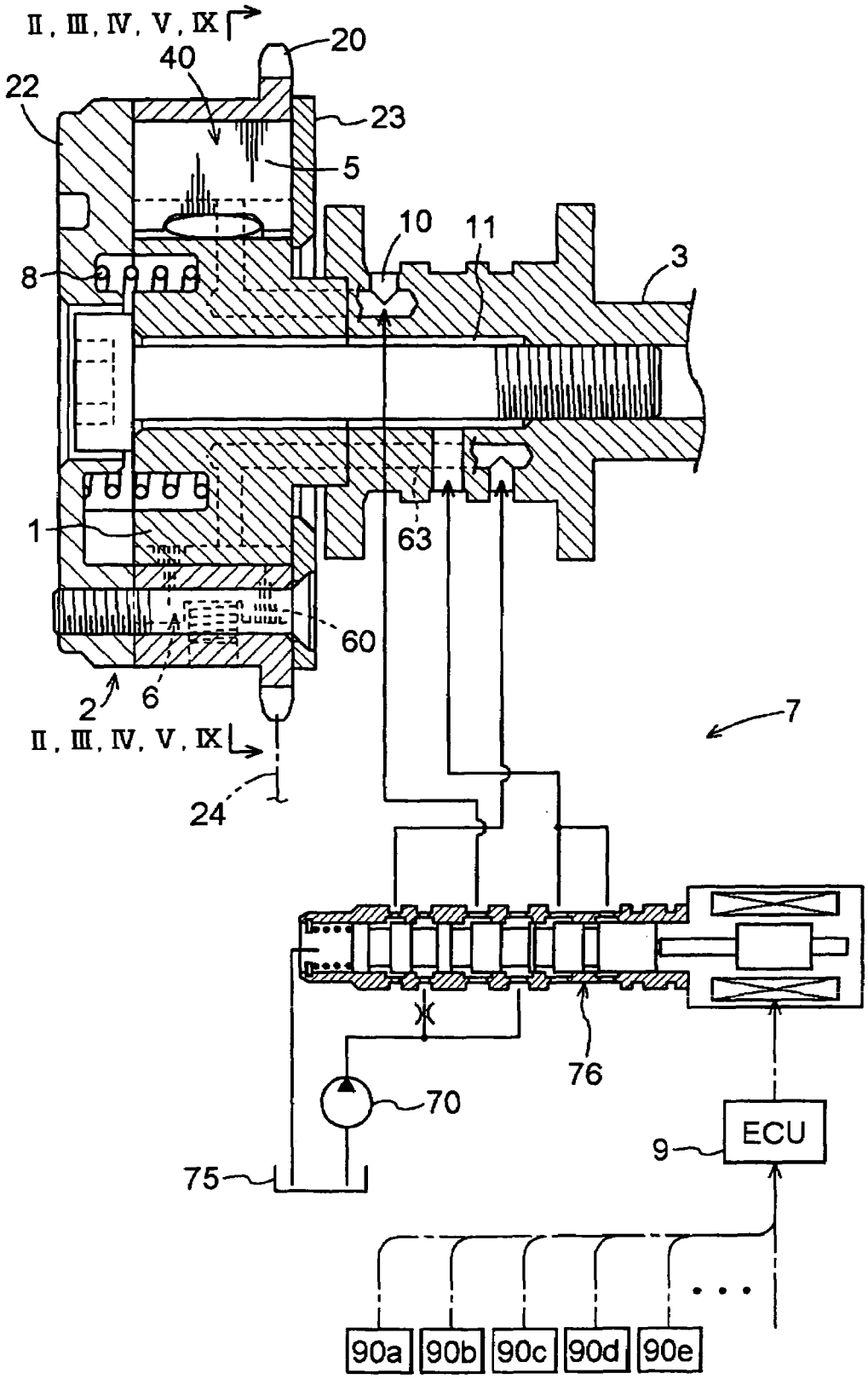
FIG. 1 represents a side cross-sectional view illustrating a schematic configuration of a valve timing control apparatus.

An embodiment of the present invention will be explained with reference to drawing figures. First, a valve timing control apparatus will be explained. A valve timing control apparatus, illustrated in FIG. 1, includes an outer rotor 2 serving as a drive rotational member which synchronously rotates with a crankshaft of an engine for a vehicle and an inner rotor 1 serving as a driven rotational member which is provided coaxially with the outer rotor 2 and which is rotated with a camshaft 3.

The inner rotor 1 is integrally attached to an end portion of the camshaft 3. The camshaft 3 is supported by a cylinder head of an engine and rotatable with the cylinder head. The outer rotor 2 is provided around the inner rotor 1. The outer rotor 2 is rotatable relative to the inner rotor 1 within a predetermined range of a relative rotational phase. The outer rotor 2 includes a front plate 22, a rear plate 23, and timing sprockets 20 integrally provided along a periphery of the outer rotor 2.

Between the timing sprockets 20 and a gear attached to the crankshaft of the engine is provided a transmission member 24 such as a timing chain, a timing belt, or the like.

In this configuration, when the crankshaft is driven to rotate, the rotational energy is transmitted to the timing sprockets 20 via the transmission member 24. Accordingly, the outer rotor 2 including the timing sprockets 20 is driven to rotate in a rotational direction S illustrated in FIG. 2. Further, the inner rotor 1 is driven to rotate in the rotational direction S, and in turn the camshaft 3 is rotated. Then, a cam provided at the camshaft 3 presses an intake valve or an exhaust valve downward to open the intake valve or the exhaust valve.

Figure 2:
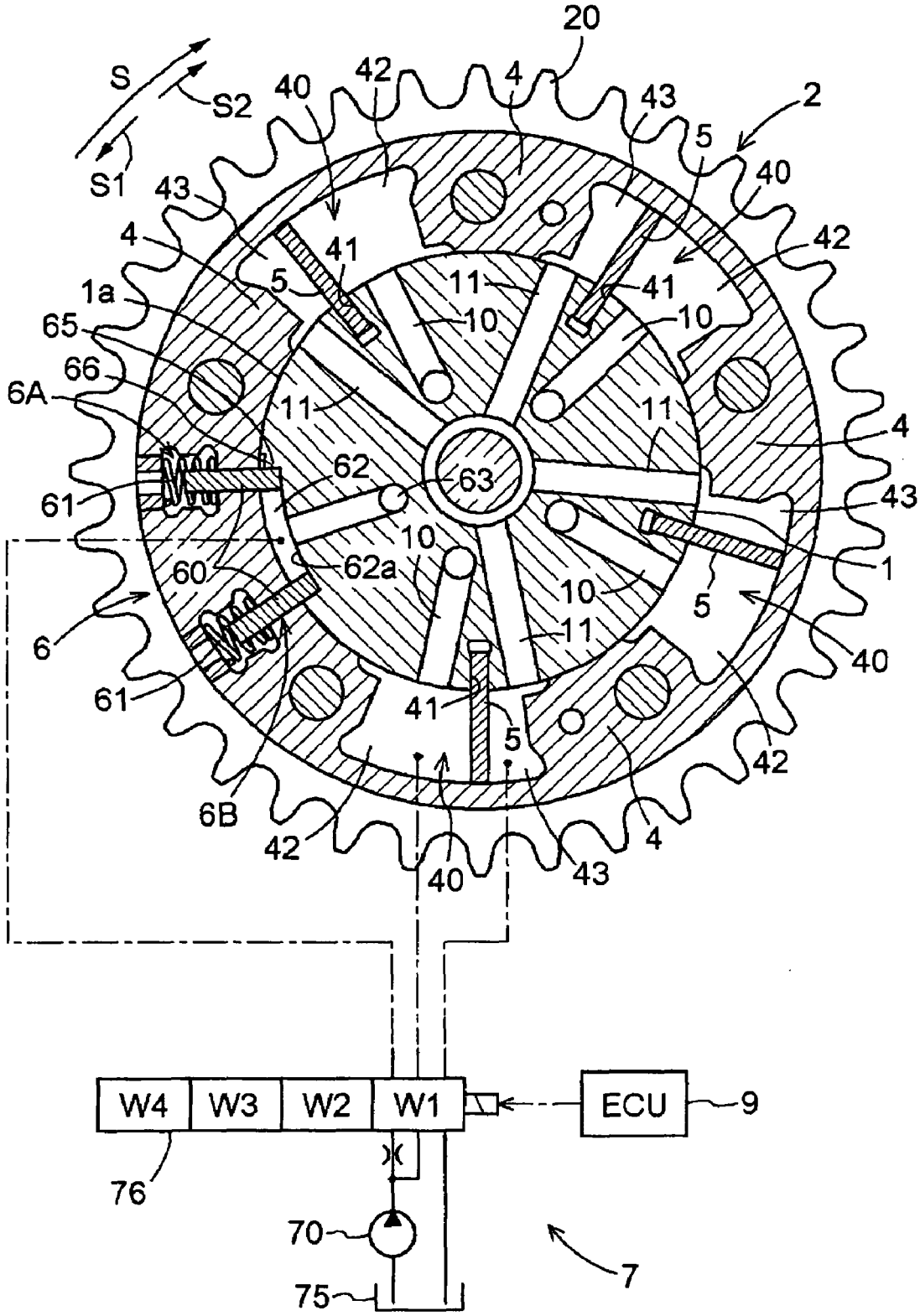
FIG. 2 represents an elevational cross-sectional view illustrating a state of lock of a relative rotational phase exerted by a lock mechanism.

Next, a fluid pressure chamber will be explained. As illustrated in FIG. 2, the outer rotor 2 includes plural protruding portions 4 for playing a role as shoes protruding inwardly along a radial direction each provided along a rotational direction with a distance from other. Then, between each adjacent protruding portion 4 forms a fluid pressure chamber 40 defined between the inner rotor 1 and the outer rotor 2.

Along a periphery of the inner rotor 1 facing each fluid pressure chamber 40 is provided a vane groove 41. A vane 5, which divides the fluid pressure chamber 40 in terms of a relative rotational direction (directions of arrows S1, S2 illustrated in FIG. 2) into an advanced angle chamber 43 and a retarded angle chamber 42, is inserted into the vane groove 41 so as to slide along a radial direction. Incidentally, in the embodiment, the vane 5 is separately formed from the inner rotor 1, and inserted into the vane groove 41 of the inner rotor 1. However, it is not limited. A vane, extending in a radial direction from an outer peripheral portion of the inner rotor, can be integrally formed with an inner rotor serving as a driven rotational member. Alternatively, a vane can be provided at an outer rotor serving as a drive rotational member.

Further, the advanced angle chamber 43 communicates with an advanced angle passage 11 formed in the inner rotor 1, the retarded angle chamber 42 communicates with a retarded angle passage 10 formed in the inner rotor 1, and the advanced angle passage 11 and the retarded angle passage 10 is connected to a fluid pressure circuit 7.

Figure 4:
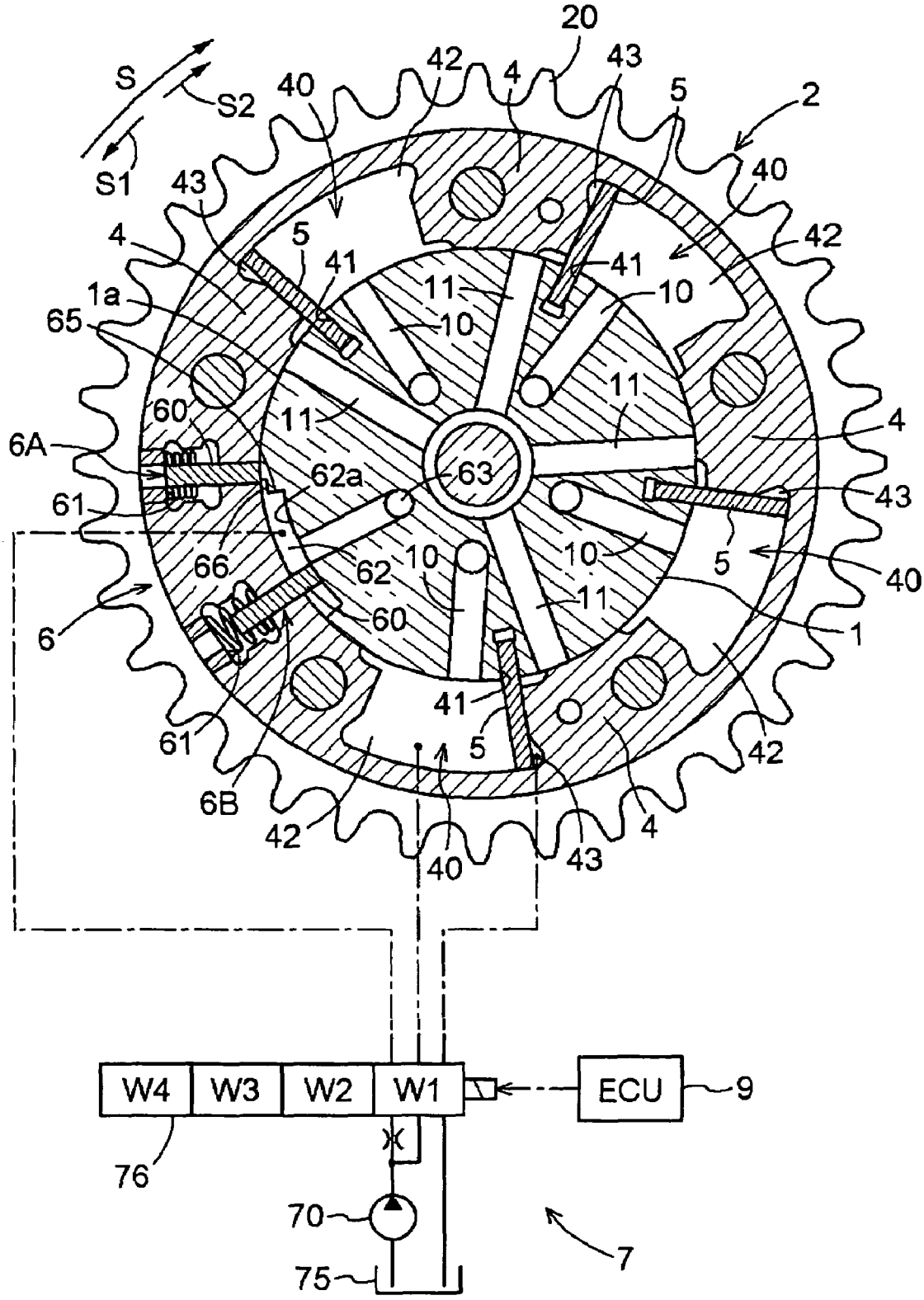
FIG. 4 represents an elevational cross-sectional view illustrating a most retarded angle phase.

Next, a fluid pressure circuit will be explained. The fluid pressure circuit 7 serves as a relative rotational phase-controlling mechanism for controlling a relative rotational phase between the inner rotor 1 and the outer rotor 2 (referred as a relative rotational phase below) by means of supplying or discharging an engine fluid as a working fluid into or from one or both of the advanced angle chamber 43 and the retarded angle chamber 42 through the advanced angle passage 11 and the retarded angle passage 10 for changing a relative position of the vane 5 to the fluid pressure chamber 40. The relative rotational phase is adjustable within a range between a most advanced angle phase (a relative rotational phase between the rotors 1 and 2 when a volume of the advanced angle chamber 43 becomes maximum) and a most retarded angle phase (a relative rotational phase between the rotors 1 and 2 when a volume of the retarded angle chamber 42 becomes maximum). FIG. 4 represents an elevational cross-sectional view of an apparatus when the relative rotational phase is at a state of the most retarded angle phase.

More precisely, the fluid pressure circuit 7 includes, as illustrated in FIG. 1, a pump 70 driven by driving force from the engine for supplying an engine fluid serving as a working fluid or a locking fluid, which will be described later, to a control valve 76, the control valve 76 of a solenoid type controlled by an ECU 9 which controls the amount of electricity supplied to the control valve 76 for moving a spool in order to supply or discharge the engine fluid through plural ports, and an oil pan 75 in which the engine fluid is stored. The advanced angle passage 11 and the retarded angle passage 10 are connected to predetermined ports of the control valve 76.

Next, a biasing mechanism will be explained. As illustrated in FIG. 1, between the inner rotor 1 and the outer rotor 2 is provided a torsion spring 8 serving as a biasing mechanism for biasing the relative rotational phase between the rotors 1 and 2 to the advanced angle. The torsion spring 8 biases the outer rotor 2 relative to the inner rotor 1, as seen in FIG. 2, to a direction indicated by the arrow S1. The torsion spring 8 enables a start lock more efficiently.

Next, a locking mechanism and a locking fluid chamber will be explained. Between the inner rotor 1 and the outer rotor 2 is provided a locking mechanism 6 which can restrain a relative rotation between the rotors 1 and 2 when the relative rotational phase between the rotors 1 and 2 is within a predetermined intermediate phase (lock phase) set between the most advanced angle phase and the most retarded angle phase.

The locking mechanism 6 includes a retarded locking portion 6A and an advanced locking portion 6B, both provided at the outer rotor 2, and a locking fluid chamber 62 which is a recess provided at a part of a peripheral portion of the inner rotor 1.

Each of the retarded locking portion 6A and the advanced locking portion 6B includes a locking member 60 provided at the outer rotor 2 slidably in a radial direction and a spring 61 for biasing the locking member 60 inwardly along a radial direction. Incidentally, a shape of the locking member 60 may be a plate, pin, or the like.

When the locking member 60 of the retarded locking portion 6A is inserted into the locking fluid chamber 62, the relative rotation of the inner rotor 1 to the outer rotor 2 toward the retarded angle direction (a direction indicated by the arrow S1 in FIG. 2) from the lock phase is inhibited. When the locking member 60 of the advanced locking portion 6B is inserted into the locking fluid chamber 62, the relative rotation of the inner rotor 1 to the outer rotor 2 toward the advanced angle direction (a direction indicated by the arrow S2 in FIG. 2) from the lock phase is inhibited. In other words, if either one of the retarded locking portion 6A or the advanced locking portion 6B is inserted into the locking fluid chamber 62, a phase change toward either one of the retarded angle or the advanced angle is inhibited, and a phase change toward the other is permitted.

Figure 5:
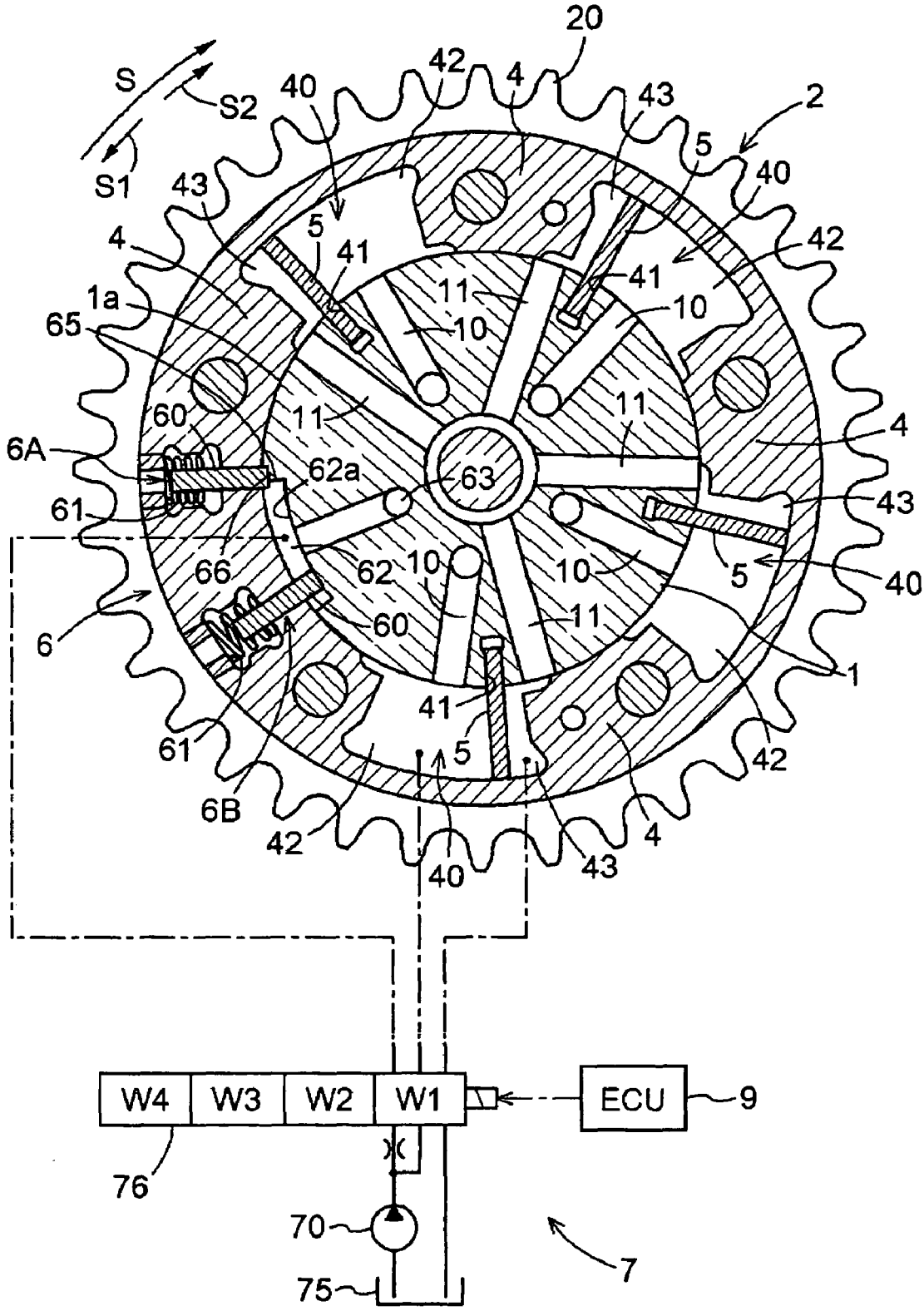
FIG. 5 represents an elevational cross-sectional view illustrating a state where a first restriction is applied.

In an illustrated example, the locking fluid chamber 62 includes a restricting step portion 66 provided on a wall 65 of the locking fluid chamber into which the retarded locking portion 6A is inserted (a surface of a wall which connects an outer circumferential surface 1*a* of the inner rotor 1 and a surface of a bottom 62*a* of the locking fluid chamber 62, the surface of the wall provided along a radial direction of the inner rotor 1). When the retarded locking portion 6B is inserted into the locking fluid chamber 62 as in a state illustrated in FIG. 5, the restricting step portion 66 inhibits a change of the relative rotational phase toward the retarded angle from a phase between the most retarded angle phase (a phase illustrated in FIG. 4) and an intermediate phase (a phase illustrated in FIGS. 2 and 3), which will be referred as a restriction phase, and permits a change of the relative rotational phase toward the advanced angle from the restriction phase. Such mechanism for restricting as described above will be referred as a restricting means.

As illustrated in FIG. 2, when both locking members 60 of the retarded angle locking portion 6A and the advanced angle locking portion 6B are inserted into the locking fluid chamber 62, the relative rotational phase between the rotors 1 and 2 can be restrained within a predetermined intermediate phase (lock phase) set between the most advanced angle phase and the most retarded angle phase. The state described above will be referred as a state of lock. Incidentally, the lock phase is set so that an open/close timing of the engine valve suitable for smooth start of the engine can be obtained.

Figure 3:
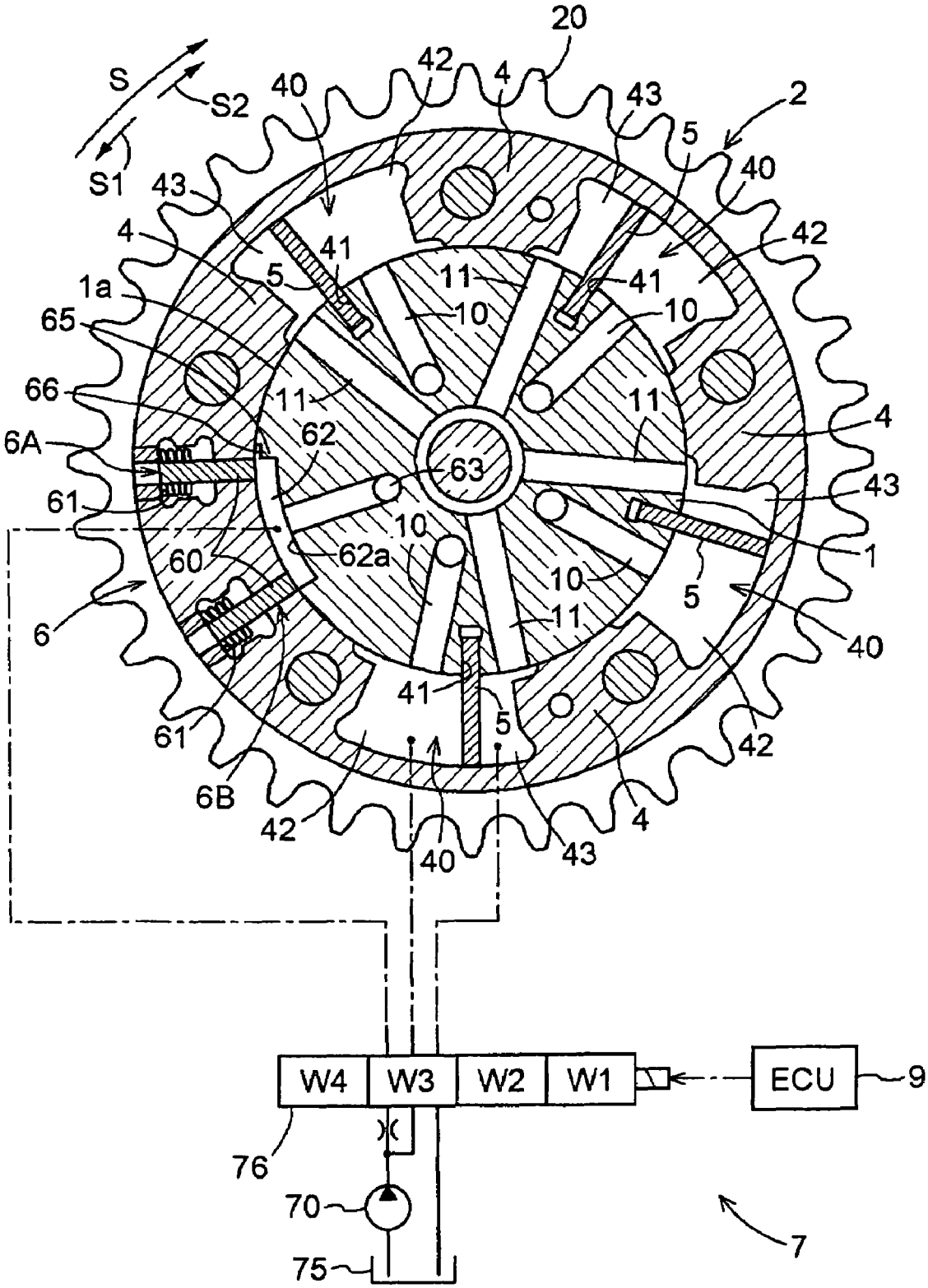
FIG. 3 represents an elevational cross-sectional view illustrating a state where lock exerted by the lock mechanism is released.

The locking fluid chamber 62 communicates with a locking fluid passage 63 provided in the inner rotor 1, and the locking fluid passage 63 is connected to a predetermined port of the control valve 76 of the fluid pressure circuit 7. In other words, the fluid pressure circuit 7 is configured to supply or discharge an engine fluid as a locking fluid to the locking fluid chamber 62 through the locking fluid passage 63. When the locking fluid is supplied to the locking fluid chamber 62 from the control valve 76, as illustrated in FIG. 3, the locking members 60 are pulled back toward the outer rotor 2, and thus a state of lock of the relative rotation between the rotors 1 and 2 is released. The release is performed, for example, when valve timing control such as advanced angle control or retarded angle control starts after the engine starts preferably in the state of the intermediate lock.

Incidentally, in the embodiment, the locking mechanism is structured so that both of the retarded angle locking portion 6A and the advanced angle locking portion 6B are inserted into the locking fluid chamber 62 to restrain the relative rotational phase at the intermediate phase, in other words, to make a state of lock. However, it is not limited. A locking mechanism can be structured by one locking member and one locking fluid chamber. Further, in the embodiment, the locking fluid chamber 62 is formed in the inner rotor 1 serving as the driven rotational member. Then, the locking members 60, accommodated in the outer rotor 2 serving as the drive member, are inserted into the locking fluid chamber 62 to make a state of lock. However, it is not limited. A locking mechanism can be structured so that a fluid pressure chamber is formed in a drive rotational member, and a locking member accommodated in a driven rotational member is inserted into the fluid pressure chamber to make a state of lock.

Figure 6:
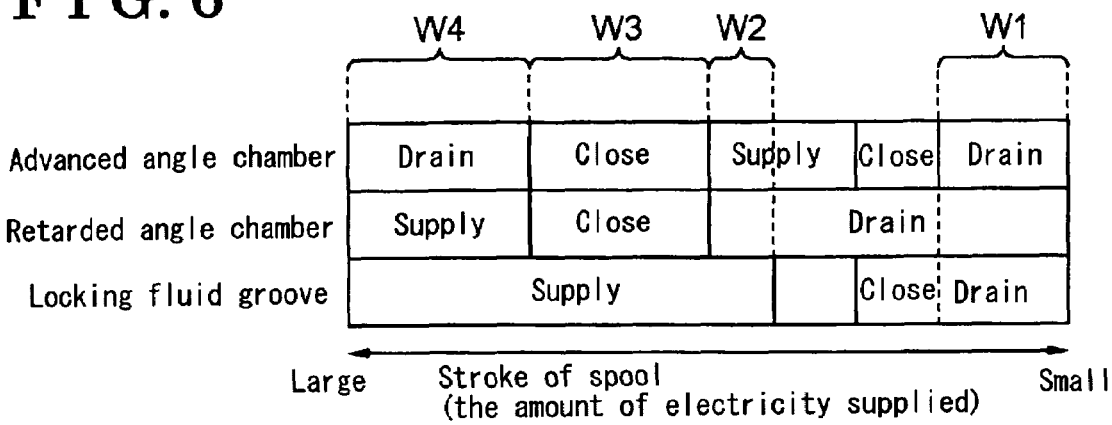
FIG. 6 represents a diagram illustrating operations of a control valve.

Next, the hydraulic pressure circuit will be explained. As illustrated in FIGS. 1 and 6, the control valve 76 of the hydraulic pressure circuit 7 moves the spool within a range from a position W1 to a position W4 proportionally to the amount of electricity supplied from the ECU 9. Thus, the control valve 76 can be switched between states of supplying or discharging an engine fluid as a working fluid or a locking fluid into or from the advanced angle chamber 43, the retarded angle chamber 42, and the locking fluid chamber 62, or stopping both operations.

In other words, when the spool of the control valve 76 is placed at the position W1, a working fluid in the advanced angle chamber 43 and the retarded angle chamber 42, and a locking fluid in the locking fluid chamber 62 can be discharged to the oil pan 75 (drain operation).

When the spool of the control valve 76 is placed at the position W2, the locking fluid is supplied into the locking fluid chamber 62 and thus a state of lock of a relative rotation between the rotors 1 and 2 is released. Further, a working fluid in the retarded angle chamber 42 is discharged and a working fluid is supplied into the advanced angle chamber 43, and thus the relative rotational phase between the rotors 1 and 2 is moved toward the advanced angle direction S2 (operation for transition toward the advanced angle).

When the spool of the control valve 76 is placed at the position W3, a state of lock of a relative rotation between the rotors 1 and 2 is released, supply of a working fluid into the advanced angle chamber 43 and the retarded angle chamber 42 is stopped, and thus a relative rotational phase between the rotors 1 and 2 is kept at a phase at a time of stopping (operation for holding the relative rotational phase).

When the spool of the control valve 76 is placed at the position W4, a state of lock of a relative rotation between the rotors 1 and 2 is released, a working fluid in the advanced angle chamber 43 is discharged, a working fluid is supplied into the retarded angle chamber 42, and thus a relative rotational phase between the rotors 1 and 2 is moved toward the retarded angle direction S1 (operation for transition toward the retarded angle). Incidentally, operations and configurations of the control valve 76 is not limited to one described above, and changes can be made if possible.

Next, an electric control unit (ECU) will be explained. An ECU 9 is provided at an engine and includes a memory in which a predetermined program or the like is stored, a central processing unit (CPU), an input/output interface, or the like. The ECU 9 serves as a control mechanism of the valve timing control apparatus.

To the ECU 9, detection signals from a cam angle sensor 90*a* for detecting a phase of the camshaft, a crank angle sensor 90*b* for detecting a phase of the crankshaft, a fluid temperature sensor 90*c* for detecting a temperature of an engine fluid, a rotational frequency sensor 90*d* for detecting a rotational frequency of the crankshaft (a rotational frequency of an engine), an ignition key switch (abbreviated to IG/SW) 90*e* are transmitted. Further, detection signals from various types of sensors, for example, a vehicle speed sensor, an engine cooling water temperature sensor, or a throttle angle sensor, or the like, can be transmitted to the ECU 9. The ECU 9 can calculate a relative rotational phase between the rotors 1 and 2, in other words, a relative rotational phase between the rotors 1 and 2 in the valve timing control apparatus on the basis of a phase of the camshaft detected by the cam angle sensor 90*a*, and a phase of the crankshaft detected by the crank angle sensor 90*b*.

The ECU 9 controls the amount of electricity supplied to the control valve 76 of the hydraulic pressure circuit 7 on the basis of an engine operation parameter such as an engine fluid temperature, a rotational frequency of the crankshaft, a vehicle speed, a throttle angle, or the like described above, to control a relative rotational phase between the rotors 1 and 2 so that the relative rotational phase become suitable for such operation parameters.

Next, a setting of torque of the biasing mechanism will be explained. As described above, the valve timing control apparatus includes the relative rotational phase-controlling mechanism and the biasing mechanism. Thus, the start lock is performed at the intermediate phase. A setting of torque of the torsion spring 8 serving as the biasing mechanism will be explained in detail as follows. A torque is set so that the torque becomes between a minimum set torque and a maximum set torque. The minimum set torque is set on the basis of FIG. 7A as described above, and the maximum set torque is set on the basis of FIG. 7B.

Next, the minimum set torque will be explained. The minimum set torque is selected from a first torque t1 and a second torque t2. The first torque t1 is a minimum torque for changing the relative rotational phase from the most retarded angle phase to the intermediate phase when a hydraulic pressure is discharged from both the advanced angle chamber 43 and the retarded angle chamber 42 at a first temperature before warming up of the engine (a first temperature illustrated in FIG. 7A, for example, 0° C.) during cranking. The second torque t2 is a minimum torque for changing the relative rotational phase from the most retarded angle phase to the intermediate phase when a hydraulic pressure remains in the advanced angle chamber 43 and the retarded angle chamber 42 at a second temperature at which the relative rotational phase-controlling mechanism can control the phase (a second temperature illustrated in FIG. 7A, for example, 20° C.) during cranking. A greater torque than the other is selected as the minimum set torque. In an illustrated example, the second torque t2 is higher. Accordingly, the second torque t2 will be utilized as the minimum set torque.

Further, as described above, the valve timing control apparatus includes the restricting step portion 66. Accordingly, both the first torque t1 and the second torque t2 are set to a greater torque selected from a torque required for the locking member 60 to be inserted into the restricting step portion 66 from the most retarded angle phase or a torque required for achieving the intermediate phase from a phase at which the locking member 60 is inserted into the restricting step portion 66 (restriction phase). In the embodiment, both torques become approximately identical. A reason why both torques are set according to the method described above has been explained above.

Figure 7A:
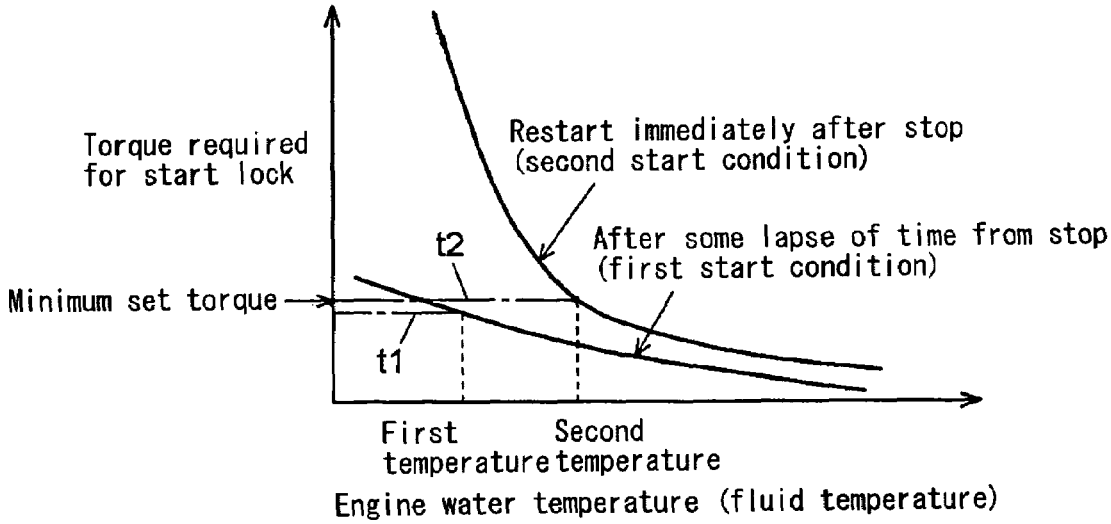
FIGS. 7A and 7B represent explanatory charts referred for setting a torque of a biasing mechanism.
Figure 7B:
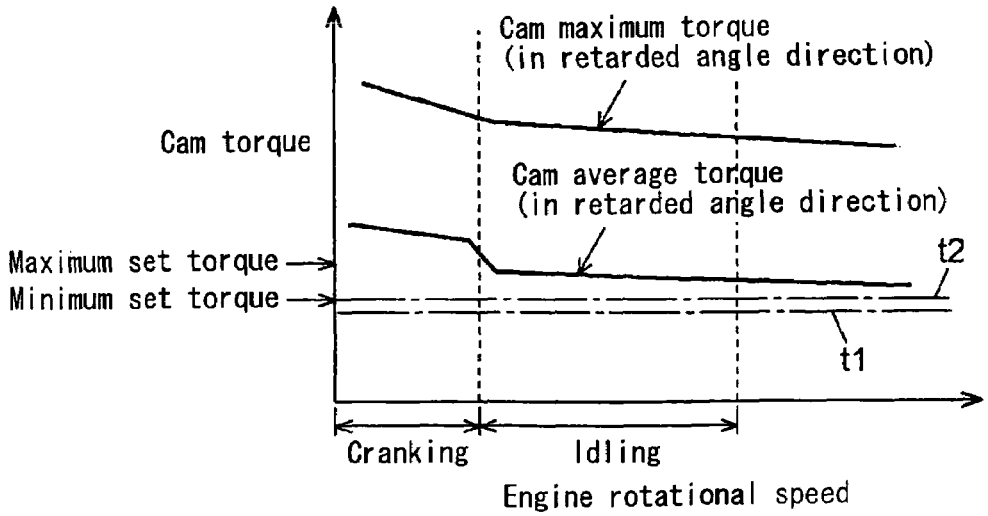

Next, the maximum set torque will be explained. The maximum set torque is determined considering controllability of a valve timing control. The maximum set torque of the biasing mechanism 8 is determined as a cam average torque during idling in which response speed for controlling the relative rotational phase toward the advanced angle becomes identical to response speed for controlling the relative rotational phase toward the retarded angle. The torque can be determined as an average value of a cam average torque distribution during idling, as illustrated in FIG. 7B.

By the method for setting the minimum set torque and the maximum set torque described above, a valve timing control apparatus can be obtained in which a torque of the biasing mechanism is set larger than a larger one of the first torque and the second torque and is set smaller than a cam average torque during idling in which response speed for controlling the relative rotational phase toward the advanced angle becomes identical to response speed for controlling the relative rotational phase toward the retarded angle. By setting the torque of the biasing mechanism as described above, minimum torque, which is required for realizing the start lock, and which can control the relative rotational phase to some extent, can be obtained.

On the other hand, even in a case where an engine stops while the relative rotational phase is positioned between the most advanced angle phase and the intermediate phase, the relative rotational phase needs to come back to the intermediate phase by means of cranking. Accordingly, considering this situation, the maximum set torque of the biasing mechanism 8 is set to a cam average torque during cranking. This torque can be an average value of a cam average torque distribution during cranking illustrated in FIG. 7B. By the method for setting the minimum set torque and the maximum set torque, a valve timing control apparatus can be obtained in which a torque of a biasing mechanism is set larger than a larger one of the first torque and the second torque and is set smaller than a cam average torque during cranking. By setting a torque of the biasing mechanism as described above, even in a case where an engine stops while the relative rotational phase is positioned between the most advanced angle phase and the intermediate phase, a minimum torque for getting the relative rotational phase back to the intermediate phase and for realizing the start lock by means of cranking can be obtained.

Figure 8:
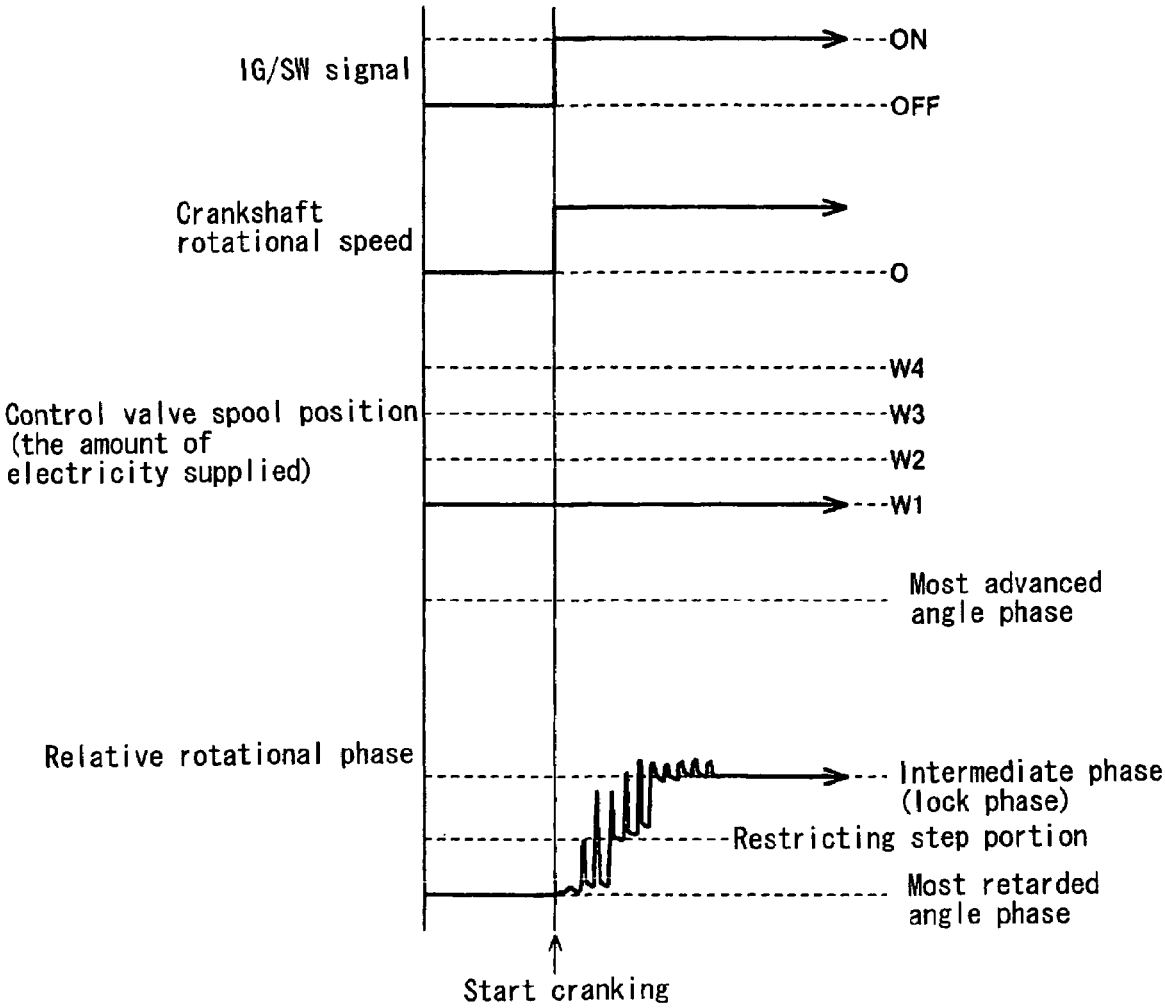
FIG. 8 represents a timing chart illustrating a state of some parameters at a time of starting an engine.

Next, controls for the valve timing control apparatus will be explained. A state of control of the valve timing control apparatus when the engine starts will be explained with reference to FIG. 8.

The ECU 9 serving as the control mechanism performs cranking for starting engine when an engine start signal is transmitted from the IG/SW 90*e*. When the engine starts, the spool of the control valve 76 is placed at the position W1 so that a working fluid in the advanced angle chamber 43 and the retarded angle chamber 42 and a locking fluid in the locking fluid chamber 62 are discharged.

Then, at the state where the working fluid in the advanced angle chamber 43 and the retarded angle chamber 42 are discharged, the crankshaft is rotated according to the process of cranking. As a result, the vane 5 starts reciprocating in the hydraulic pressure chamber 40 by periodically changing cam torque generated at the camshaft for reciprocating the valve. Then, the relative rotational phase between the rotors 1 and 2 periodically changes, and advances toward the advanced angle by effect of biasing from the biasing mechanism 8. As a result, as the relative rotational phase illustrated in FIG. 8, when the relative rotational phase is at the most retarded angle phase as illustrated in FIG. 4, the relative rotational phase sequentially transfers toward the advanced angle. Then, the relative rotational phase is restricted by the restricting step portion 66 (illustrated in FIG. 5), and then locked at the intermediate phase (illustrated in FIG. 2). At the time of start, a pair of locking members 60 is biased toward the inner rotor 1 by the spring 61.

In other words, while the pair of locking members 60 is biased toward the inner rotor 1, the relative rotational phase between the rotors 1 and 2 changes periodically and sequentially transfers toward the advanced angle. Then, when the relative rotational phase between the rotors 1 and 2 becomes the intermediate phase (lock phase), the pair of locking members 60 is inserted into the locking fluid chamber 62. Thus, the relative rotational phase between the rotors 1 and 2 is locked at the lock phase and the rotors 1 and 2 become a state of lock. When the relative rotational phase between the rotors 1 and 2 is rapidly locked at the lock phase as described above at the time of starting the engine, the engine can be started preferably.

Figure 9:
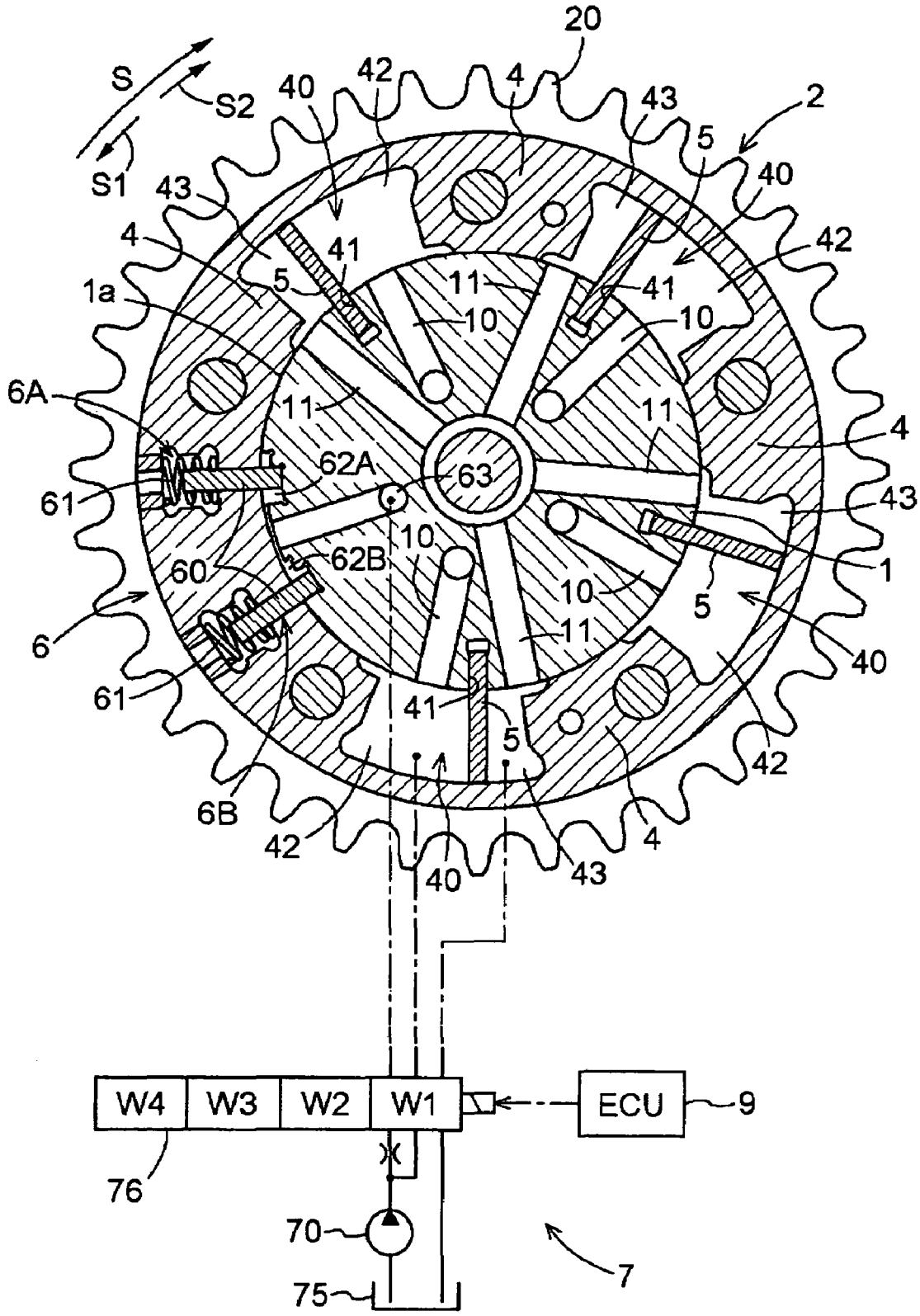
FIG. 9 represents an elevational cross-sectional view illustrating a valve timing control apparatus including three-steps restriction phases between the most retarded angle phase and an intermediate phase.
Figure 10A:
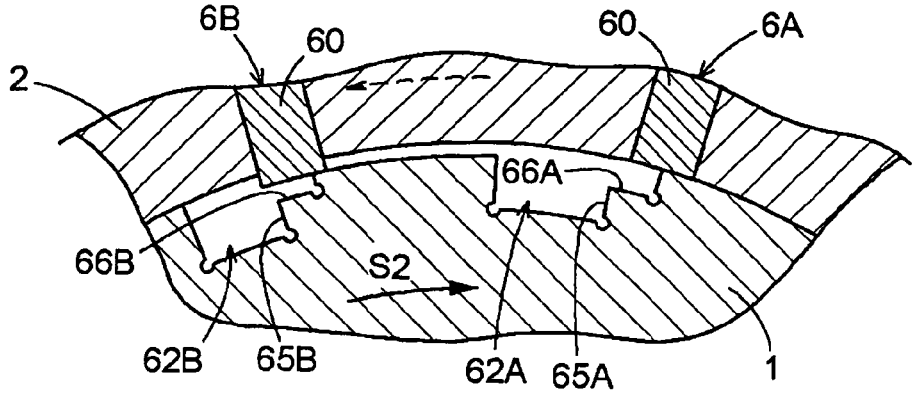
FIGS. 10A, 10B and 10C represent diagrams illustrating the valve timing control apparatus illustrated in FIG. 9 in states where a phase change toward the retarded angle is restricted.
Figure 10B:
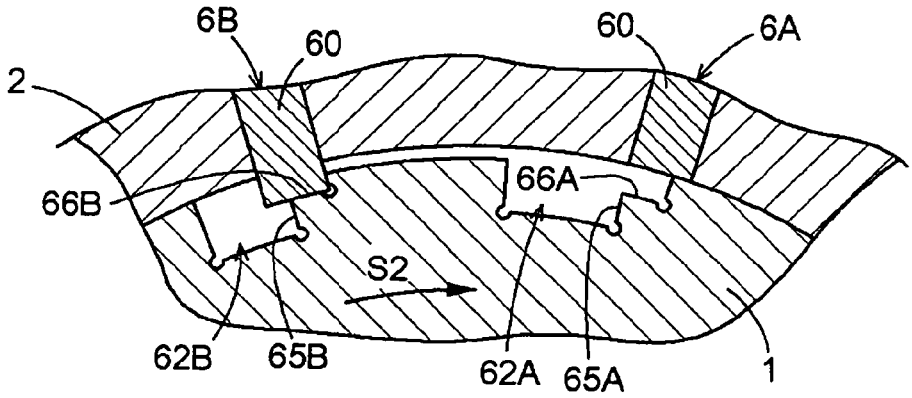
Figure 10C:
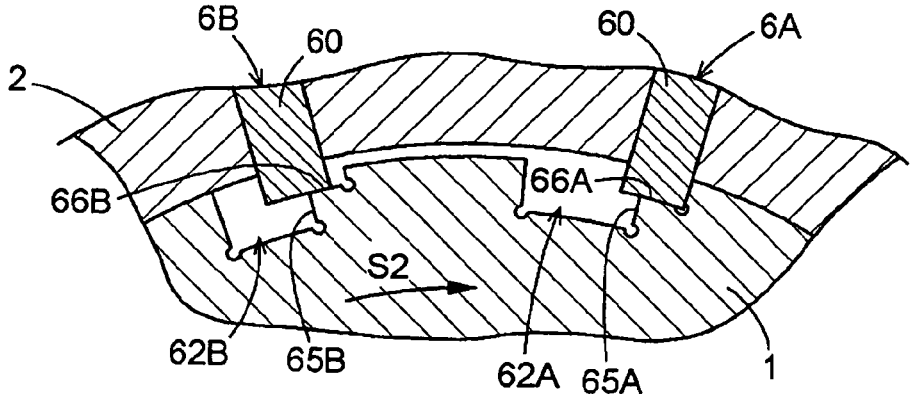
Figure 11A:
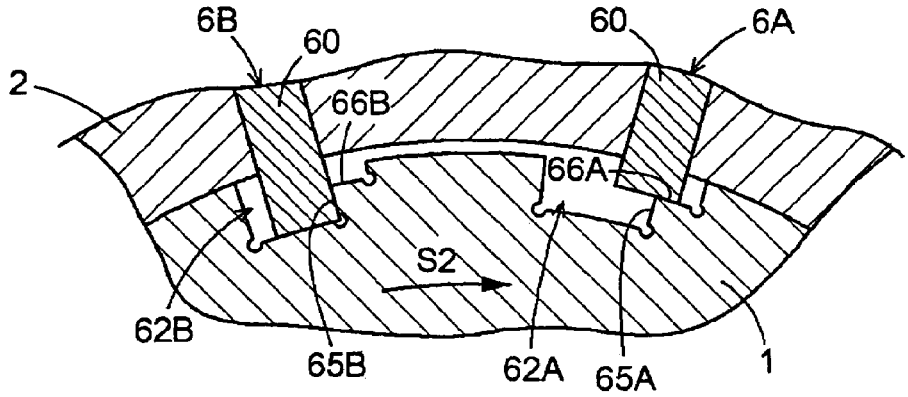
FIGS. 11A and 11B represent diagrams illustrating states where a phase change is restricted continued from FIG. 10C.
Figure 11B:
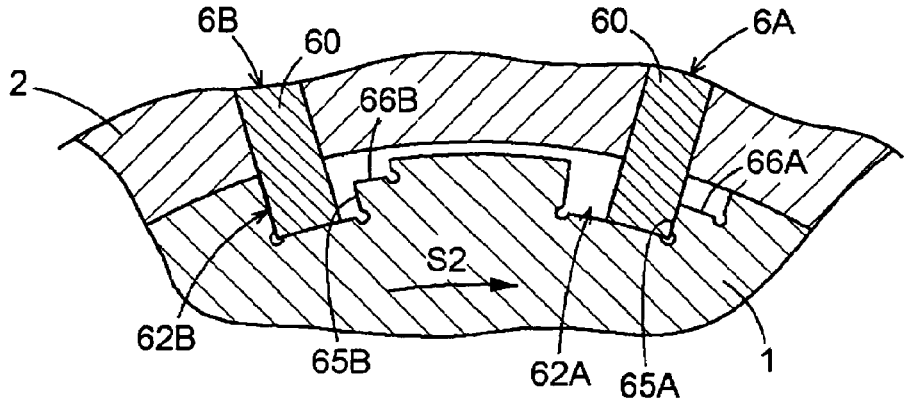
Figure 12:
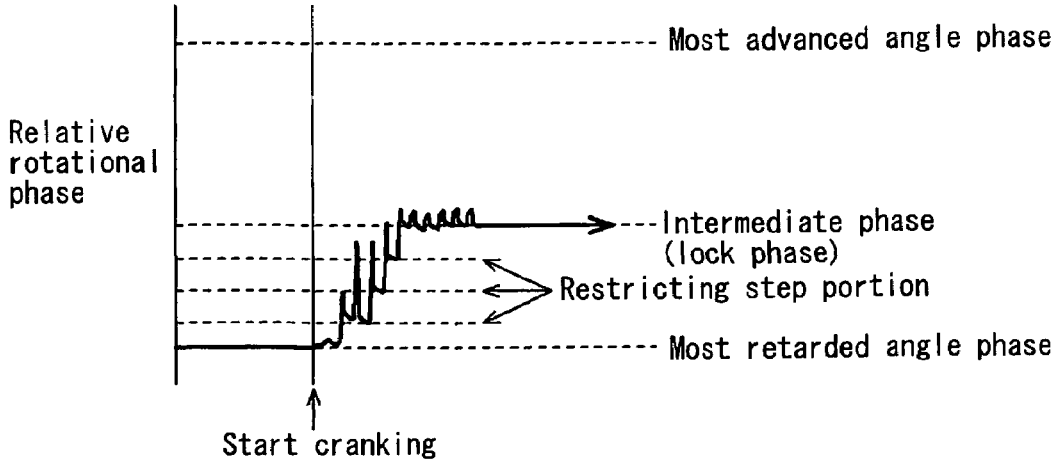
FIG. 12 represents a timing chart illustrating changes of the relative rotational phase in the valve timing control apparatus illustrated in FIG. 9.

Next, a first additional embodiment will be explained. In the embodiment described above, the valve timing control apparatus, having a structure of intermediate locking, included the locking portions 6 including the retarded angle locking portion 6A and the advanced angle locking portion 6B and the locking fluid chamber 62 for being inserted by the locking portion 6 and a one-step step portion 66 for restricting the phase from being changed toward the retarded angle. However, the structure is not limited. Restriction of the phase from being changed toward the retarded angle can be applied at more phases. FIGS. 9, 10A–10C, 11A–11B, and 12 represent an example where restriction can be exerted at more phases. FIG. 9 represents an elevational cross-sectional view illustrating a valve timing control apparatus at a phase where the intermediate lock is exerted, corresponding to FIG. 2. FIGS. 10A–10C and 11A–11B represent a state of lock of the locking mechanism 8 at the state where sequential stepping-ups are performed from the most retarded angle phase to the intermediate phase. The phase transfers toward the intermediate phase in an order as illustrated in FIG. 10A, FIG. 10B, FIG. 10C, FIG. 11A, and FIG. 11B. FIG. 12 represents a timing chart corresponding to the relative rotational phase illustrated in FIG. 8.

In the additional embodiment, two locking fluid chambers 62A and 62B are provided for the locking portion 6A and the locking portion 6B respectively. A step portion 66A is provided on one wall surface 65A of the locking fluid chamber 62A. A step portion 66B is provided on one wall surface 65B of the locking fluid chamber 62B. A phase, at which the locking members 60 are inserted to the restricting step portions 66A and 66B, is sequentially shifted. Accordingly, plural times of stepping-up can be performed. FIG. 12 represents a situation where sequential stepping-ups are performed.

In setting of a torque of the valve timing control apparatus according to the additional embodiment, setting of a minimum set torque of the torsion spring 8 follows a method for setting the first torque t1 and the second torque t2 as described above. Further, a highest torque is, as the minimum set torque, selected from an earlier step torque for changing the relative rotational phase from the most retarded angle phase to a restriction phase closest to the most retarded angle phase, an intermediate step torque for changing the relative rotational phase from the restriction phase to a next restriction phase closer to the intermediate phase, or a later step torque for changing the relative rotational phase from a restriction phase farthest from the most retarded angle phase to the intermediate phase. By so doing, a phase can be changed from the most retarded angle phase to the intermediate phase, in other words, an intermediate lock. In the illustrated example, phase differences of these stepping-up operations are approximately identical. Accordingly, a torque of the torsion spring 8 can be set so that stepping-up by this phase difference can be performed by, for example, approximately one or two cycles of crankshaft rotation with reliability.

Next, a second additional embodiment will be explained. In the embodiment described above, in setting of a torque of the torsion spring 8 serving as the biasing mechanism, a cam average torque, during idling in which response speed for controlling the relative rotational phase toward the advanced angle becomes identical to the response speed for controlling the relative rotational phase toward the retarded angle, is selected as the maximum set torque. However, it is not limited. A maximum of a cam average torque during cranking can be selected as the maximum set torque.

Next, a third additional embodiment will be explained. It is preferable that a torque set for the biasing mechanism 8 be as small as possible in view of a valve timing control. Accordingly, it may be preferable if a minimum set torque of the biasing mechanism 8 is selected by following the method described above and a maximum set torque is set to 10 to 15% increase of the minimum set torque. Thus, the set torque, which is set as low as possible, is preferable.

According to a first aspect of the present invention, a valve timing control apparatus for an engine includes a drive rotational member synchronously rotated with a crankshaft, a driven rotational member provided coaxially with the drive rotational member and rotated with a camshaft, a fluid pressure chamber provided in one of the drive rotational member and the driven rotational member, a vane dividing the fluid pressure chamber into an advanced angle chamber and a retarded angle chamber, a relative rotational phase-controlling mechanism for supplying or discharging a working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum, a locking mechanism for restraining the relative rotational phase at an intermediate phase between the most advanced angle phase and the most retarded angle phase, and a biasing mechanism for applying a torque to the drive rotational member relative to the driven rotational member so that the relative rotational phase advances toward the most advanced angle phase. A larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as a minimum set torque for the biasing mechanism.

A minimum value of a torque generated by the biasing mechanism is set according to following conditions. Because an intermediate lock structure is employed, strictest condition in this valve timing control apparatus is required to move the relative rotational phase at the most retarded angle phase when cranking is started to the intermediate phase. Accordingly, the biasing mechanism requires a torque which can perform the intermediate lock.

Here, a torque should be considered under following two situations. At a first start condition, an engine is started after relatively long period of stop. At a second start condition, an engine is started immediately after the engine is stopped. The biasing mechanism requires a condition such that the start lock should be performed with reliability under two start conditions. FIG. 7A represents a state of torque which is required (which enables) to change the relative rotational phase from the most retarded position to the intermediate lock phase under the first start condition and the second start condition. In FIG. 7A, a vertical axis represents a water temperature (or fluid temperature) of the engine, a vertical axis represents a torque required for the start lock. The required torque is a torque required for the relative rotational phase to achieve the intermediate phase from the most retarded angle phase by, for example, several cycles of rotation of the crankshaft. FIG. 7A represents a torque t1 required under the first start condition and a torque t2 required under the second start condition.

As can be seen from this figure, a required torque declines as the temperature rises. Further, under the first start condition, because the engine is left for a long period of time and sufficiently cooled, and a fluid is discharged, an influence of the temperature is small, and the torque substantially corresponds to a sliding resistance. In contrast, comparing with the first start condition, a degree of decrease in torque under the second start condition is substantially larger. This is because, under the second start condition, restart of an engine is supposed immediately after the engine stops. In other words, the start lock is supposed to be performed in the state where a fluid is remained in some chambers, and thus the vane needs to be moved against the hydraulic pressure to change the relative rotational phase.

In view of start conditions of the engine, an intermediate lock needs to be performed preferably under two start conditions described above. Under the first start condition, a start lock needs to be performed over entire range of arbitral temperature in which the engine may be started (for example, −5° C. to 40° C.). A minimum temperature in this temperature range will be referred as a first temperature, and a torque required at the first temperature will be referred as a first torque t1. In contrast, under the second start condition, it is sufficient if the start lock is performed in the temperature range in which the relative rotational phase-controlling mechanism starts a phase control under the condition that the engine water temperature (fluid temperature) is relatively high (for example, 10° C. to 20° C.). As can be understood from consideration how the intermediate lock would be utilized in the second start condition, necessity of a start lock in a condition of lower temperature is not envisioned, and considerations for lower temperature are not required. In other words, when a temperature of engine water (fluid temperature) is lower than the temperature range described above because of unstable combustion in the engine, the relative rotational phase is restrained by the locking mechanism. Accordingly, in a condition of temperature lower than the temperature range described above, the engine stops with a state of an intermediate lock. Therefore, when the engine is restarted, the start lock is not required. Accordingly, a torque of the biasing mechanism can be set without considering the start lock in this case. A minimum temperature in this temperature range, in other words, a minimum temperature at which the relative rotational phase is controlled by the relative rotational phase-controlling mechanism, will be referred as a second temperature, and a torque required at the second temperature will be referred as a second torque t2.

As described above, an engine can be started preferably by considering these first temperature and second temperature, and by setting a torque which can start the engine at the first temperature and second temperature as a minimum set torque of the biasing mechanism (a minimum torque acceptable for the biasing mechanism).

According to a second aspect of the present invention, in a method for setting a minimum torque for a biasing mechanism of a valve timing control apparatus for an engine, the valve timing control apparatus includes a drive rotational member synchronously rotated with a crankshaft, a driven rotational member provided coaxially with the drive rotational member and rotated with a camshaft, a fluid pressure chamber provided in one of the drive rotational member and the driven rotational member, a vane dividing the fluid pressure chamber into an advanced angle chamber and a retarded angle chamber, a relative rotational phase-controlling mechanism for supplying or discharging an working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum, a locking mechanism for restraining the relative rotational phase at an intermediate phase between the most advanced angle phase and the most retarded angle phase, and a biasing mechanism for applying a torque to the drive rotational member relative to the driven rotational member so that the relative rotational phase advances toward the most advanced angle phase. A larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as the minimum torque.

In order to determine a minimum set torque of the biasing mechanism, a restricting mechanism is provided for restricting the relative rotational phase from moving back toward the retarded angle and for permitting the relative rotational phase to advance toward the advanced angle while the relative rotational phase moves from the most retarded angle position to the intermediate phase (where the intermediate lock will be exerted). This kind of structure is so called a stepping-up structure. There are cases in which a single step of a restriction phase is provided between the most retarded angle phase and the intermediate phase, or plural steps of restriction phases are provided between the most retarded angle phase and the intermediate phase. Then, in order to preferably perform intermediate lock, in a case of a single step of a restriction phase, it is sufficient if a torque is set to a value which can change a phase from the most retarded angle phase to the restriction phase, and from the restriction phase to the intermediate phase. In a case that plural restriction phases are set, a torque is required which can change a phase from the most retarded angle phase to a restriction phase closest to the most retarded angle phase, from one restriction phase to another restriction phase, from a restriction phase closest to the intermediate phase to the intermediate phase.

Accordingly, in the configuration described above in the first aspect, the first torque and the second torque should be set as follows while a requirement at the first temperature and the second temperature described above is fulfilled.

First, a case of the configuration including a single step of a restriction phase will be explained. When a restricting means is provided which functions with the locking mechanism for permitting change of the relative rotational phase toward the intermediate phase and for restricting change of the relative rotational phase toward the most retarded angle phase when the relative rotational phase is at a restriction phase provided between the most retarded angle phase and the intermediate phase, a larger one of an earlier step torque required for changing the relative rotational phase from the most retarded angle phase to the restriction phase and a later step torque required for changing the relative rotational phase from the restriction phase to the intermediate phase is selected as the first torque at the first temperature and the second torque at the second temperature. By so doing, in a case where the relative rotational phase is changed from the most retarded angle phase to the intermediate phase and a start lock is exerted, the relative rotational phase can achieve the restriction phase located between the most retarded angle phase and the intermediate phase with reliability, and a start lock can be rapidly exerted with reliability. Further, a torque required for this operation can be small.

Next, a case of the configuration including plural steps of restriction phases will be explained. When a restricting means is provided which functions with the locking mechanism for permitting change of the relative rotational phase toward the intermediate phase and for restricting change of the relative rotational phase toward the most retarded angle phase when the relative rotational phase is at one of restriction phases provided between the most retarded angle phase and the intermediate phase, the largest one of an earlier step torque required for changing the relative rotational phase from the most retarded angle phase to a retarded side restriction phase closest to the most retarded angle phase, an intermediate step torque required for changing the relative rotational phase from a one of the restriction phases to another of the restriction phases next to the one of the restriction phases, and a later step torque required for changing the relative rotational phase from a advanced side restriction phase farthest from the most retarded angle phase to the intermediate phase is selected as the first torque at the first temperature and the second torque at the second temperature. By so doing, in a case where the relative rotational phase is changed from the most retarded angle phase to the intermediate phase and a start lock is exerted, the relative rotational phase can achieve the restriction phase located between the most retarded angle phase and the intermediate phase with reliability, and a start lock can be rapidly exerted with reliability. In addition, a torque required for this operation can be much smaller.

In the above explanation, a maximum value for setting a torque of the biasing mechanism (acceptable maximum torque for the biasing mechanism) is not particularly described. In this case, even when the relative rotational phase is located at the most advanced angle, the relative rotational phase should be come back to the intermediate phase by effect of cranking. Accordingly, a maximum value of the maximum set torque acceptable for the biasing mechanism becomes a cam average torque during cranking. Further, in view of a controllability of the valve timing control, it is preferable that a torque of the biasing mechanism be set as low as possible. Accordingly, it is preferable that the maximum set torque is set to a cam average torque during idling in which response speed for controlling the relative rotational phase toward the advanced angle becomes identical to response speed for controlling the relative rotational phase toward the retarded angle.

Situations described above will be explained as follows with reference to FIG. 7B. FIG. 7B represents a graph, in which a horizontal axis represents a rotational speed of an engine and a vertical axis represents a torque of a cam. The torque of the cam corresponds to a set torque for the biasing mechanism illustrated in FIG. 7A. In FIG. 7B, the first torque t1 and the second torque t2 are indicated by dashed lines. Further, in the same figure, a cam average torque during cranking, a cam average torque during idling, and a maximum torque of the cam are indicated by solid lines.

As can be seen from the figure, a cam average torque successively declines as the rotational speed of the engine rises. The cam average torque is relatively high during cranking and relatively low after idling. Accordingly, when a start lock from the most advanced angle phase to the intermediate phase is considered, biasing force of the biasing mechanism cannot be higher than a maximum value of the cam average torque. Further, when a controllability of the valve timing control is considered, a preferable control can be performed if the maximum set torque is set to a cam average torque during idling in which response speed for controlling the relative rotational phase toward the advanced angle becomes identical to response speed for controlling the relative rotational phase toward the retarded angle.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control apparatus for an engine, comprising:

a drive rotational member synchronously rotated with a crankshaft;

a driven rotational member provided coaxially with the drive rotational member and rotated with a camshaft;

a fluid pressure chamber provided in one of the drive rotational member and the driven rotational member;

a vane dividing the fluid pressure chamber into an advanced angle chamber and a retarded angle chamber;

a relative rotational phase-controlling mechanism for supplying or discharging a working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum;

a locking mechanism for restraining the relative rotational phase at an intermediate phase between the most advanced angle phase and the most retarded angle phase; and a biasing mechanism for applying a torque to the drive rotational member relative to the driven rotational member so that the relative rotational phase advances toward the most advanced angle phase, wherein a larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as a minimum set torque for the biasing mechanism.

2. The valve timing control apparatus according to claim 1, further comprising a restricting means for permitting change of the relative rotational phase toward the intermediate phase and for restricting change of the relative rotational phase toward the most retarded angle phase when the relative rotational phase is at a restriction phase provided between the most retarded angle phase and the intermediate phase, wherein a larger one of an earlier step torque required for changing the relative rotational phase from the most retarded angle phase to the restriction phase and a later step torque required for changing the relative rotational phase from the restriction phase to the intermediate phase is selected as the first torque at the first temperature and the second torque at the second temperature.

3. The valve timing control apparatus according to claim 1, further comprising a restricting means for permitting change of the relative rotational phase toward the intermediate phase and for restricting change of the relative rotational phase toward the most retarded angle phase when the relative rotational phase is at one of restriction phases provided between the most retarded angle phase and the intermediate phase, wherein the largest one of an earlier step torque required for changing the relative rotational phase from the most retarded angle phase to a retarded side restriction phase closest to the most retarded angle phase, an intermediate step torque required for changing the relative rotational phase from a one of the restriction phases to another of the restriction phases next to the one of the restriction phases, and a later step torque required for changing the relative rotational phase from a advanced side restriction phase farthest from the most retarded angle phase to the intermediate phase is selected as the first torque at the first temperature and the second torque at the second temperature.

4. The valve timing control apparatus according to claim 1, wherein a maximum set torque for the biasing mechanism is a cam average torque during cranking.

5. The valve timing control apparatus according to claim 2, wherein a maximum set torque for the biasing mechanism is a cam average torque during cranking.

6. The valve timing control apparatus according to claim 3, wherein a maximum set torque for the biasing mechanism is a cam average torque during cranking.

7. The valve timing control apparatus according to claim 1, wherein a maximum set torque for the biasing mechanism is a cam average torque during idling in which response speed for controlling the relative rotational phase toward the advanced angle becomes identical to response speed for controlling the relative rotational phase toward the retarded angle.

8. The valve timing control apparatus according to claim 2, wherein a maximum set torque for the biasing mechanism is a cam average torque during idling in which response speed for controlling the relative rotational phase toward the advanced angle becomes identical to response speed for controlling the relative rotational phase toward the retarded angle.

9. The valve timing control apparatus according to claim 3, wherein a maximum set torque for the biasing mechanism is a cam average torque during idling in which response speed for controlling the relative rotational phase toward the advanced angle becomes identical to response speed for controlling the relative rotational phase toward the retarded angle.

10. The valve timing control apparatus according to claim 1, wherein a torque of the biasing mechanism is set larger than a larger one of the first torque and the second torque, and smaller than a cam average torque during cranking.

11. The valve timing control apparatus according to claim 2, wherein a torque of the biasing mechanism is set larger than a larger one of the first torque and the second torque, and smaller than a cam average torque during cranking.

12. The valve timing control apparatus according to claim 3, wherein a torque of the biasing mechanism is set larger than a larger one of the first torque and the second torque, and smaller than a cam average torque during cranking.

13. The valve timing control apparatus according to claim 1, wherein a torque of the biasing mechanism is set larger than a larger one of the first torque and the second torque, and smaller than a cam average torque during idling in which response speed for controlling the relative rotational phase toward the advanced angle becomes identical to response speed for controlling the relative rotational phase toward the retarded angle.

14. The valve timing control apparatus according to claim 2, wherein a torque of the biasing mechanism is set larger than a larger one of the first torque and the second torque, and smaller than a cam average torque during idling in which response speed for controlling the relative rotational phase toward the advanced angle becomes identical to response speed for controlling the relative rotational phase toward the retarded angle.

15. The valve timing control apparatus according to claim 3, wherein a torque of the biasing mechanism is set larger than a larger one of the first torque and the second torque, and smaller than a cam average torque during idling in which response speed for controlling the relative rotational phase toward the advanced angle becomes identical to response speed for controlling the relative rotational phase toward the retarded angle.

16. The valve timing control apparatus according to claim 1, wherein a torque of the biasing mechanism is set within a range from 10% to 15% increase of the minimum set torque.

17. The valve timing control apparatus according to claim 2, wherein a torque of the biasing mechanism is set within a range between 10% to 15% increase of the minimum set torque.

18. The valve timing control apparatus according to claim 3, wherein a torque of the biasing mechanism is set within a range between 10% to 15% increase of the minimum set torque.

19. A method for setting a minimum torque for a biasing mechanism of a valve timing control apparatus for an engine, the valve timing control apparatus comprising:

a drive rotational member synchronously rotated with a crankshaft;

a driven rotational member provided coaxially with the drive rotational member and rotated with a camshaft;

a fluid pressure chamber provided in one of the drive rotational member and the driven rotational member;

a vane dividing the fluid pressure chamber into an advanced angle chamber and a retarded angle chamber;

a relative rotational phase-controlling mechanism for supplying or discharging an working fluid to or from one or both of the advanced angle chamber and the retarded angle chamber, for changing a relative position of the vane to the fluid pressure chamber, and for controlling a relative rotational phase between the drive rotational member and the driven rotational member within a range from a most retarded angle phase at which a volume of the retarded angle chamber becomes maximum to a most advanced angle phase at which a volume of the advanced angle chamber becomes maximum;

a locking mechanism for restraining the relative rotational phase at an intermediate phase between the most advanced angle phase and the most retarded angle phase; and a biasing mechanism for applying a torque to the drive rotational member relative to the driven rotational member so that the relative rotational phase advances toward the most advanced angle phase, wherein a larger one of a first torque which is a minimum torque required for changing the relative rotational phase from the most retarded angle phase to the intermediate phase in a case where a fluid pressure is discharged from both of the advanced angle chamber and the retarded angle chamber and cranking is performed at a first temperature before warming up of the engine and a second torque which is a minimum torque required for changing the relative rotational phase from the most retarded angle phase to the intermediate phase in a case where hydraulic pressure remains in the advanced angle chamber and the retarded angle chamber and cranking is performed at a second temperature which is a minimum temperature at which the relative rotational phase is controlled by the relative rotational phase-controlling mechanism is selected as the minimum torque.

* * * * *